US008931549B2

(12) United States Patent
Smith

(10) Patent No.: US 8,931,549 B2
(45) Date of Patent: Jan. 13, 2015

(54) METHOD AND APPARATUS FOR A SUBTERRANEAN AND MARINE-SUBMERSIBLE ELECTRICAL TRANSMISSION SYSTEM FOR OIL AND GAS WELLS

(76) Inventor: David Randolph Smith, Midland, TX (US)

( * ) Notice: Subject to any disclaimer, the term of this patent is extended or adjusted under 35 U.S.C. 154(b) by 965 days.

(21) Appl. No.: 13/071,348

(22) Filed: Mar. 24, 2011

(65) Prior Publication Data

US 2011/0234421 A1 Sep. 29, 2011

Related U.S. Application Data

(60) Provisional application No. 61/318,182, filed on Mar. 26, 2010.

(51) Int. Cl.

| | |
|---|---|
| ***E21B 43/00*** | (2006.01) |
| ***E21B 47/12*** | (2012.01) |
| ***H01B 1/02*** | (2006.01) |
| ***H01B 3/00*** | (2006.01) |
| *H01B 7/04* | (2006.01) |

(52) U.S. Cl.

CPC ..... *E21B 47/122* (2013.01); *H01B 1/02* (2013.01); *H01B 1/026* (2013.01); *H01B 3/004* (2013.01); *H01B 7/046* (2013.01)

USPC ..... 166/65.1; 340/854.3; 340/854.9

(58) Field of Classification Search

CPC ..... E21B 47/12; E21B 17/003; E21B 17/206

USPC ..... 340/854.9, 854.3, 854.4, 854.7; 166/65.1

See application file for complete search history.

(56) References Cited

U.S. PATENT DOCUMENTS

| | | | |
|---|---|---|---|
| 2005/0067159 | A1 | 3/2005 | Hall et al. |
| 2007/0034836 | A1 | 2/2007 | Epstein et al. |
| 2007/0044993 | A1 | 3/2007 | Varkey |
| 2008/0149363 | A1 | 6/2008 | Han et al. |
| 2009/0200290 | A1 | 8/2009 | Cardinal et al. |

OTHER PUBLICATIONS

International Search Report and Written Opinion of the International Searching Authority, issued May 26, 2011, from International Application No. PCT/US2011/29852.

*Primary Examiner* — Albert Wong

(74) *Attorney, Agent, or Firm* — Fulbright & Jaworski LLP

(57) ABSTRACT

The present invention is directed towards methods of oil and gas well logging, monitoring, and the field of electrically powering submersible devices like electrical motors in oil and gas wells.

31 Claims, 4 Drawing Sheets

METHOD AND APPARATUS FOR A SUBTERRANEAN AND MARINE-SUBMERSIBLE ELECTRICAL TRANSMISSION SYSTEM FOR OIL AND GAS WELLS

CROSS-REFERENCE TO RELATED APPLICATIONS

This application claims priority to U.S. provisional patent application Ser. No. 61/318,182, filed on Mar. 26, 2010.

TECHNICAL FIELD

The present invention is directed to a method and apparatus for a marine-submersible and subterranean electrical transmission systems for oil and gas wells and marine applications. More specifically, this invention overcomes previous shortcomings of submersible logging cables by teaching methods and apparatus to construct submersible electrical transmission systems using novel methods of manufacturing, and well logging. The invention includes methods and apparatus for well logging lines that have synergistic electrical, hydraulic, and structural functionality vastly superior to the current oil and gas industry wire line methods. The invention provides a new way to achieve superior line durability, reparability, safety, hydraulic functionality, and optical functionality as opposed to current methods known today. This invention also teaches towards constructing electrical submersible transmission line systems having buoyancy control features for the industrial purpose of transferring electrical power from surface to submersible environments.

BACKGROUND OF THE INVENTION

When a wellbore is constructed in the earth it is convenient thereafter to deploy electrical logging devices from surface into the well bore to record subterranean data. These logging devices, can be deployed as single devices, like pressure and temperature gauges, or as a long assembly of different devices often referred to in the oil and gas industry as a suite of logging tools attached together in a submersible assembly to the distal end of a submersible electric transmission system commonly referred to as electrical wire line or logging cable.

These logging tools are often deployed in wells in conjunction with explosive submersible perforating guns wherein the logging tools report to surface in real-time via data transmitted up a communication line (typically, an electric wire line), the depth of the perforating logging system in the well thereby enabling the logging operator at surface to trigger devices at a particular required depth by transmitting a signal through the communication line to which they are attached and subsequently fire the subterranean shaped charged guns at the required position in the well.

The vast majority of these subterranean logging tools and perforating systems are electrically powered from surface, a few are powered electrically from subterranean batteries, and still fewer are powered hydraulically. Additionally, it is typical and convenient for the data recorded by the subterranean logging tools to transmit the data in real time from the subterranean environment to the surface via the communication line for recording, and human observation of the data. This data is typically transmitted to surface through electrical communication wires embedded in a wire rope configuration.

The advent of optical fiber construction methods and technology, has resulted in vast increases in data transmission bandwidth. The pioneering of optical power methods from the surface telecommunications industry has presented the potential to transmit vast new amounts of data using light launched through optical wave guides from submersible environments using submersible logging instruments and optical fibers. However, the current logging cables used in the oil and gas industry are not ideally suited to the deployment of optical fiber. This is because the optical fiber, being made out of glass, has different thermal coefficients of expansion and stretch characteristics compared to the wire line logging cable largely constituted from steel wires and tubes. Moreover, when an optical fiber deployed in current logging cable breaks or darkens, the current wire line logging cables are not easily amenable to repair or replacement of the optical fiber. What is needed is a method and cable system that is amenable to both protecting, repairing, and replacing optical fiber in logging cables.

Likewise, in submersible environments offshore in the oil and gas industry, it is often of interest to run submersible electrical transmission lines from the surface to the seafloor. As water depths from which hydrocarbons are extracted continue to get deeper, sometimes over 10,000 feet of water depth, the weight of submersible electrical cables becomes a limiting factor. These systems are often deployed from large coiled reels from barges, and are connected to sub-sea well heads on the distal end of the submersible electrical cable, and return back to the host platforms at the proximal end. The current art teaches towards the use of steel wire and tubes to add strength to these electrical submersible transmission system. The current art also teaches towards the use of bouncy buoys attached to electrical submersible transmission systems, as a means to reduce the weight hanging from surface and said load being transferred to the electrical copper cables. As the oil and gas industry goes into deeper water depths, the density control of the submersible electrical transmission line becomes of interest. What is needed is a means to control the weight and cost of operating and repairing submersible electric transmission cables.

There are fundamental design problems with current industry teaching towards electric wire line logging cable. One such problem is related to the steel wires used as structural members and the combination of these wires and subsequent bundle or wire wrap geometry with the electrical wires and optical fibers disposed in said current well logging cable systems. This class of logging cable is often known as "wire-line" or "electric wire-line" and the method of construction is known to those familiar with the art of wire-rope. Firstly, the initial capital cost of the steel wires used as structural members in the logging wire line of the current state of the art reduces the number of wells that can afford the logging technology. These cables are expensive and difficult to repair. The weight of the additional steel for strength and impact protection of the electrical conductor cable requires expensive surface deployment and retrieval systems sufficient to deploy and extract the heavy electric wire line cables. For example, in ultra-deep wells a dual drum capstan surface logging system must be deployed as the collapse forces and loads on the inner most electrical wire line logging cable wraps on the capstan drum of a simple single capstan system become too great and fail the material of the electrical cable and insulation braided inside the steel wire rope of today's logging systems. This dual drum system is very expensive and its large foot print poses challenges on offshore platforms, rigs, and vessels. Moreover, the inability to repair current electrical wire line logging cables containing multiple braided steel wire rope and steel tube as strength members for the logging cables power and signal transmission members made from copper and silicon dioxide is largely prohibitive.

These wire rope (also known as braided wire line) strength members are wound with many layers of wires and then have the electrical transmission members embedded within these wires and in tubes. These arrangements make repair difficult, as splicing and other repair operations involving copious numbers of braided strength wires, tubes and transmission members in a section of electric wire line logging cable becomes difficult, time consuming, and as a result, costly. Hence large amounts of logging line per year are disposed as waste due to the difficulties and costliness of repairing it.

The vast majority of wells are logged with braided electric wire containing multiple opposing layers of braided steel wire. The operators of such cable systems typically remove and discard, from the distal end of the electric wire line logging cable hundreds of feet or more after each operation, which is continually compromised during use. Wire logging line becomes compromised by the auto-gyro affect caused from well logging and the resulting cold working and fatigue stressing induced on the cables. The necessity of the continual removal of the bottom or distal portions of electrical wire line logging cables is due to the mechanical cold working and unwinding of the electric wire of the logging cable as it is run in and out of the well due to the auto-gyro phenomena introduced by well logging. This phenomena is such that the logging tool suite on the distal end of the logging cable are continually experiencing torque as the logging suite continually twists, and auto-gyros while the tools are translated in and out of the well bores. The current manufacturing of electrical logging line involves the use of multiple wraps of opposed direct windings of the braided wire or wire rope to counter act this auto-gyro affect. The current art therefore forces prudent operators to remove and dispose of the lower portion of the logging line continually, to avoid wire line cable failure and the potential loss of logging tools in the wells. Therefore due to the configuration of the currently used logging wire line cables, the cable is inherently damaged in normal operations and there are no quick and inexpensive ways to repair the wire line. It should be noted that while distal portion of current arts logging wire line cable are most often compromised, all portions are subject to fatigue, and wear damage to well gases and liquids having deleterious effects on electrical cable and steel braided wires of the cable.

This auto-gyro twisting phenomena presented by well bores and current logging line systems is a further detriment to the disposal and use of optical fiber within the current wire line configurations for well logging cables. The stretch and twist resistance of optical fibers of the current state of the art logging cables causes severe damage to the optical fibers resulting in large quantities of optical fibers in such logging lines to be broken. Steel wire has vastly different thermal coefficients of thermal expansion and elastic stretch before deformation as opposed to optical fiber, hence current methods of disposing optical fiber in wire lines made of steel is limiting the use of optical fibers. The optical fibers currently used quickly break in the wire rope wire line configurations. Once this occurs the current state of the art does not teach towards repairing or replacement of the logging line nor the optical fiber therein and damaged optical fiber in braided wire line logging cables is discarded as waste. Therefore, the current state of the art offers no commercial means to repair the optical fiber in a broken electrical wire line cable system, nor does it present a logging line system amenable to the differences between optical fiber and steel wire to enhance the life of the optical fibers.

Optical fibers in the current art logging lines fail for many reasons including hydrogen darkening, neutron bombardment, different thermal coefficients of expansion between the optical fiber and the current arts steel wire rope systems, and impacts loads that can shatter the optical fiber like those that occur during perforating.

The invention described herein includes novel combinations of methods of construction, material selection, geometrical dispositions, and repair for the industrial purpose of building a more robust commercial submersible electrical transmission system by incorporating attributes that allow for thermal expansion differences between the electrical conductive members and the optical fiber, ways to replace and repair both the optical fibers in logging line systems, and repair of the logging cable structural members for the enhancement of transmitting electrical, optical, and hydraulic power and signals in my inventions systems. This results in an unexpected low cost commercial improvement over the current art of cutting and disposing of logging line and further has lead to the discovery that the logging cable of the present invention leads to a longer life more durable submersible system, herein referred to as a submersible electrical transmission system.

The present invention includes a coaxial disposition of optical fibers inside tubes of beryllium alloys heretofore not used in submersible transmission lines as electrical conductors. This invention has the industrial purpose of building a more robust and repairable submersible electric transmission system with which to log wells. Moreover, it has been unexpectedly discovered that beryllium alloys impede hydrogen ingression into the optical fibers thereby reducing hydrogen ingress in the coaxial optical fiber disposed in the beryllium alloy tubes of the invention.

A further benefit of the present invention is a geometrical arrangement of the submersible electrical transmission systems constituents such that the beryllium used in the alloys of the present invention reflects a larger portion of neutrons than any current submersible electrical transmission system used for well logging, and thus the invention serves the industrial purpose of shielding the optical system from neutron bombardment triggered by certain submersible logging tools known to those familiar in the art of well logging.

The current state of the art uses highly electrically conductive solid copper wires to reduce the electrical resistance loses. Most submersible environments, sea and ocean, as well as land-based oil and gas wells encounter brine waters where corrosion and chloride stress cracking occurs in many well known materials like copper, stainless steel, and aluminum. Copper, while having a very low electrical resistance is dense and therefore heavy, having a density of approximately 8.94 g/cm3. Copper, has nearly 100% International Annealed Copper Standard (IACS) electrical conductivity, (indeed copper is the basis of the IACS scale for electrical conductivity), has a low material (mechanical) strength comprising a minimum yield strength at 0.2% offset of approximately 70 MPa. Hence copper electrical cable is not sufficiently strong to hang or deploy in a well or in deep offshore cable systems from platforms to the sea floor, as it cannot sustain its own weight to depths much beyond approximately 3,000 feet. Moreover, in well logging operations, it cannot support the weight of hanging a suite of subterranean logging tools, nor tensile or torque loads induced on logging cables in wells, or marine water depths where currents can cause continual movement of submersible cables.

BRIEF SUMMARY OF THE INVENTION

The present invention is directed to methods and apparatus to construct electrically powered submersible transmission systems comprising novel combinations of geometry, methods and apparatus of construction, new materials of construction, and new functionality for well logging systems. This serves the industrial purpose of creating more durable, repairable, safer, smaller, submersible electrical transmission lines for the oil and gas and as marine industry.

In one aspect of the present invention there is a structural member comprising: a conductive electrical conduit for transmission of electrical power or data, the conduit comprising: a core conductive member comprising a first conductive material, the first conductive material comprising beryllium alloy, the beryllium alloy having an electrical conductivity value greater than 25% International Annealed Copper Standard (IACS) and having a 0.2% offset yield strength greater than 30,000 psi; a first layer encapsulating the core conductive member, the first layer comprising a dielectric material; and, a second layer encapsulating the first layer; the structural member having a length of greater than or equal to 1000 feet (304.8 meters) and having a tensile strength greater than or equal to a tensile strength sufficient to resist yield under a load of its own weight.

In one embodiment, the second layer comprises a second conductive material. In one embodiment, the second conductive material comprises beryllium alloy. In one embodiment, the second conductive material comprises a doped polymer. In one embodiment, the first layer comprises amorphous polyimide. In one embodiment, the core conductive member comprises a beryllium alloy tube, wherein said beryllium alloy comprises a tubular shape with a central cavity.

In a preferred embodiment, the said beryllium alloy is copper beryllium alloy.

In some embodiments, the core conductive member comprises a beryllium alloy tube, wherein the beryllium alloy further comprises a tubular shape encapsulating a third electrically conductive material. In some embodiment, the third electrically conductive material is copper. In one embodiment, the core conductive member comprising beryllium alloy comprises a tubular shape, the tubular-shaped beryllium alloy encapsulating a fourth material. In some embodiments, the fourth material comprises an optical fiber encapsulated in a polymeric material. In one embodiment, the structural member is substantially free of an additional component providing mechanical strength to the conduit greater than or equal to the combined mechanical strength provided by said core conductive member, said first layer and said second layer. In some embodiments, the structural member consists essentially of said conductive electrical conduit; in such cases the structural member may consist of some additional components that do not significantly affect the overall mechanical strength of the member. In some embodiments, the structural member consists of said conductive electrical conduit; in such cases the structural member and the conductive electrical conduit are one and the same and there are no additional components.

In another aspect of the present invention, there is a method of transmitting electrical power or data to or from a subterranean or submarine environment to or from a second location, the method comprising: coupling, through a structural member, one or more components in the subterranean or submarine environment to one or more components at the second location, the structural member comprising: a conductive electrical conduit for transmission of electrical power or data, the conduit comprising: a core conductive member comprising a first conductive material, the first conductive material comprising beryllium alloy having an electrical conductivity value greater than 25% International Annealed Copper Standard (IACS) and having a 0.2% offset yield strength greater than 30,000 psi; a first layer encapsulating the core conductive member, the first layer comprising a dielectric material; a second layer encapsulation the first layer; the structural member having a length of greater than or equal to 1000 feet and having a tensile strength greater than or equal to a tensile strength sufficient to resist yield under a load of its own weight; and, transmitting the electrical power or data through the conductive electrical conduit between the one or more components at the second location and the one or more components in the subterranean or submarine environment.

In one embodiment, the second layer comprises a second electrically conductive material. In one embodiment, the electrical power is provided to a submarine environment in the exploration or production of hydrocarbon resources, and the second location is at or above the marine surface. In one embodiment, the electrical power is provided to a subterranean environment in the exploration or production of hydrocarbon resources, and the second location is at or above the surface of the earth. In one embodiment, the second conductive material comprises beryllium alloy. In one embodiment, the second layer encapsulation comprises a doped polymer. In one embodiment, the first layer comprises amorphous polyimide. In one embodiment, the core conductive member comprises a beryllium alloy tube, wherein the beryllium alloy comprises a tubular shape with a central cavity.

In one embodiment, the beryllium alloy is copper beryllium alloy. In one embodiment, the core conductive member comprises a beryllium alloy tube, wherein the beryllium alloy further comprises a tubular shape encapsulating a third electrically conductive material. In one embodiment, the third electrically conductive material is copper. In one embodiment, the core conductive member comprising beryllium alloy comprises a tubular shape, the tubular-shaped beryllium alloy encapsulating a fourth material. In one embodiment, the fourth material comprises an optical fiber encapsulated in a polymeric material.

In one embodiment, the conduit is substantially free of an additional component providing mechanical strength to the conduit greater than or equal to the combined mechanical strength provided by the core conductive member, the first layer and the second layer. In one embodiment, the structural member consists essentially of said conductive electrical conduit. In one embodiment, the structural member consists of said conductive electrical conduit. In preferred embodiments, the method further comprises the step of powering submersible electrical devices.

The invention differs from the current art of steel wire and steel tubing strength, by combining novel construction methods, novel electrically conductive alloys, novel encapsulation materials, having strengths significantly better than copper and heretofore never used for submersible electrical power transmission systems, deploying them in coaxial orientations, and use of the same provides novel and superior methods of repair of my electrical submersible transmission line. The invention comprises electrically conductive alloys as strength members, shields for wave guides and conductance, as well as performing the function of transmitting electricity in the electrical submersible transmission system.

One aspect of this invention includes methods of attaching submersible logging devices to the electrical submersible transmission system and transferring electrical, hydraulic, and optical power and signals through the submersible electrical transmission system for the purpose of logging, perforating, and functioning wire line deployed devices like packers, perforating guns, and plugs.

A further aspect of this invention includes the use of methods of deploying electrically conductive alloy tubes and wires as strength members and electrical conductors of power and signal transmission systems, wherein the electrical cables electrical transmission members poses sufficient mechanical strength to support its hanging weight in submersible environments, sustain the weight of other transmission cables, and additional weight from submersible logging devices deployed on the distal end of the cable. This allows resistance to impact and collapse loads during submersible deployments, retrievals, and permanent installations, adds buoyancy, in the submersible environment, while transmitting sufficient optical and electrical power and signals to operate submersible electrical logging devices attached to the electrical submersible transmission system.

A further aspect is the use of electrically conductive alloys in submersible transmission lines in novel tube and coaxial deposition of electrical, optical, and hydraulic system configurations allowing transmission systems using my invention to be used for buoyancy control and facilitating this inventions method of repairing the submersible transmission lines conductors and wave guides.

A further aspect of the present invention is the use of electrically conductive coaxial alloy tubes in electrical submersible transmission line power members wherein the electrically conductive tubular member is used to transmit fluids, electromagnetic waves, and wave guides through the electrical submersible transmission system, including dielectric fluids, magnetic fluids, cryogenic fluids, well chemical treatment fluids, and optical fibers while also transmitting electrical power and electrical signals on the electrically conductive tube.

In one aspect of the present invention, there is a method of constructing of a well logging device within a well bore comprising: constructing a submersible electrical transmission line from a copper beryllium alloy; inserting into a well bore through an elastomeric sealing element at the surface said submersible electrical copper beryllium transmission line with a proximal end of said transmission line at or near surface and a connection means to at least one electrical submersible logging device at a distal end of said transmission line; connecting said transmission line at its proximal end to at least an electrical source; energizing said transmission line; positioning said at least one electrical submersible logging device from surface at a point along said transmission line through said well bore and, retrieving said electrical submersible logging device from the well bore with the electrical conductive beryllium alloy cable system.

In other embodiments, this invention further comprises the step of converting at least one beryllium alloy strip into a continuous tube of electrical conductive alloys wherein the alloy is enhanced for strength and electrical conductivity by thermally and mechanically means.

In a further embodiments, this invention teaches the process of encapsulating the electrically conductive beryllium alloy with dielectric and conductive materials.

In some variations of the method, at least one of the electrical conductors of the electrical cable system are beryllium alloy tubes that are fluid-filled.

In a still further embodiment, the method further comprises converting an electrical conductor strip of a copper beryllium alloy and disposing coaxially inside the construction at least one additional electrical conductive member.

In a still further embodiment, the method further comprises converting an electrical conductor strip of a copper beryllium alloy into a tubular construction and disposing coaxially inside the tube construction at least one optical fiber.

In some cases, the electrical conductive cable system comprises electrically conductive beryllium alloys having tube geometry comprising a coaxial cavity proceeding from the surface location to a submersible location. In some cases, the electrically conductive cable system has dielectric fluid inside. In some cases the electrically conductive beryllium alloy tube has a magnetic fluid inside.

In one embodiment, the submersible electrical transmission system comprises at least one electrically conductive beryllium alloy tube transmitting a fluid to an expandable elastomeric sealing device commonly known as a packer thusly forming a seal in a submersible tubular above and below the expandable device.

In some cases, the electrical submersible transmission system is coupled to and interrogated with optical devices known to those familiar to the art of optics as Optical Time Domain Reflectometry system, wherein the electrical submersible transmission systems optical fiber is used as a distributive sensor in a well bore. In some embodiments the copper beryllium submersible electrical cable is filled with a dielectric fluid such as 3M Industries Fluorinert family of electronic fluids.

In some cases, the beryllium alloy is at least partially coated with an electrically insulating material. Preferred electrically insulating material comprises polyimides, and polytetrafluoroethylene.

In some embodiments the beryllium alloy preferably comprises copper.

In some cases, the beryllium alloy is at least partially encapsulated with an electrically insulating material. In some cases, multiple coatings of electrically insulating materials encapsulate the beryllium alloy.

In another embodiment the novel submersible electrical transmission system of my invention is attached to a perforating gun assembly and deployed into a well for the perforating of a well with logging devices.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

DETAILED DESCRIPTION OF THE INVENTION

Figure 1:
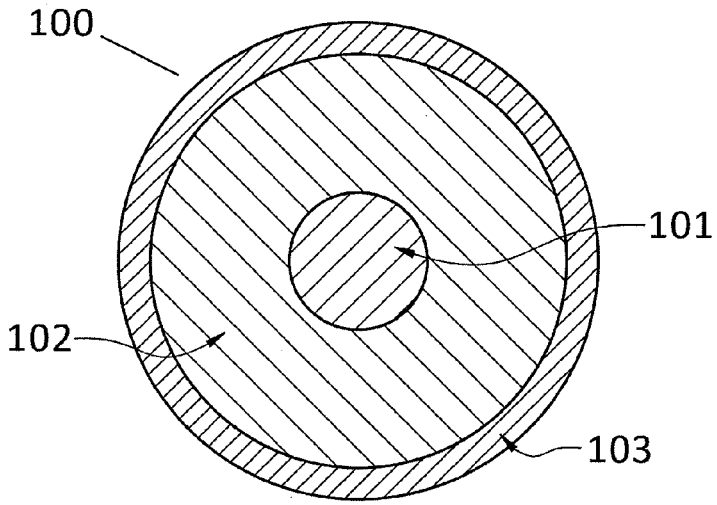
FIG. 1 illustrates a general cross sections of embodiments of the present inventions depicting combination of materials, geometric shape, electrical, and dielectric members used to construct a submersible electrical transmission system.

As used herein, "a" or "an" means one or more. Unless otherwise indicated, the singular contains the plural and the plural contains the singular. For example, as used herein, the term "logging tool" includes both a single logging tool and more than one logging tools arranged in any way, such as a suite of logging tools. Where an apparatus is said to comprise a logging tool, that apparatus should be understood include a single logging tools or a suite of logging tools. As used herein, unless otherwise indicated or otherwise clear from the context, the word "or" includes both the conjunctive and the disjunctive and means "and or", sometimes written as "and/or". Thus, the phrase "transmission of electrical power or data", should be understood to mean "transmission of electrical power and/or data". Thus, the present invention therefore encompasses all three of the following: 1) conduits for transmission of both electrical power and data, 2) conduits for transmission of electrical power alone, and 3) conduits for the transmission of data alone. Similarly, the invention encompasses methods of transmitting all three of the following: 1) electrical power and data, 2) electrical power alone, and 3) data alone.

As used herein, "line", when used in terms of a transmission line, encompasses single wire, a bundle of wires, a rod, or a tube which may contain wires, optical fibers, electrical devices and combinations thereof.

As used herein "submersible" means capable of being deployed below a surface. The surface can be a land surface or the marine surface. Thus, "submersible" means both marine-submersible and subterranean submersible. The term "marine-submersible" means both of 1) below the water surface but above the seafloor, and 2) below both the water surface and the seafloor.

As used herein, "surface" means locations at or above the surface of the earth. The term surface includes both 1) a water/air surface such as those in marine and non-marine bodies of water, and 2) an earth/air surface on land (i.e., the ground).

As used herein, "electrically conductive" is electrical conductivity greater than 1% of the International Annealed Copper Standard, (IACS), wherein this standard is based on an annealed copper wire having a density of 8.89 g/cm$^3$, 1 meter in length, weighing 1 gram, with a resistance of 0.15328 ohms. This standard is assigned the value 100 at 20° C. (68° F.).

As used herein, yield strength or yield point, of a material is defined as the point on a stress versus strain curve wherein a material begins to deform plastically, hence any load that increases the stress beyond this point will permanently and irreversibly deform the material. Some materials do not have well defined yield points or a yield strength, it is therefore convenient in engineering science to define the yield strengths by the "offset yield method, wherein a line is drawn parallel to the linear elastic portion of a material's stress strain curve intersecting the abscissa at a value of 0.2% of strain and the stress strain curve for the material. The intersection of this line and the stress-strain curve of the given material is defined as the 0.2% offset yield strength.

As used herein, the term, "alloy which may obtain" refers to the art of modifying the properties of alloys by thermal, mechanical, electromagnetic methods, including but not limited to, tempering, quenching, annealing, aging, drawing, peening, electromagnetic pulsing, aging means and methods well know to those in the field of metallurgy wherein the alloys of this inventions electrical and mechanical properties can be enhanced by the methods and means including but not limited to, series of process steps of heating, annealing, drawing, cooling, quenching, peening, aging, and otherwise aging, mechanically and thermally working the alloys to impart desired properties into the grain structure of the alloy. The term "alloy which may obtain", is then understood by those familiar to the art of metallurgy to include means to impart various properties to an alloy, including the alloys described herein. This includes any number of process steps and combinations thereof imposed upon the alloy during processing of the alloy and/or processing of the alloy into a finished product or thereafter in the shaping of the alloy, including but not limited to, melting, casting, hot rolling, cold rolling, solution annealing, age hardening, precipitation-hardening, mechanical deformation, solution annealing, temperature controlled curing, and aging, from the original wrought melt of an alloy to the finial shaping of the alloy into a geometrical shape or device.

The present invention is directed toward a electrical power/data transmission line for use in the oil and gas industry, said electrical power/data transmission line also being a structural member having enough tensile strength to withstand the hanging load of its own weight over at least 1000 feet (304.8 meters).

Attention is first directed to FIG. 1 wherein one embodiment of the present invention is shown. Briefly, FIG. 1 illustrates a cross-section of an embodiment of the electrical power or data transmission device. The device 100 is an electrical power or data transmission conduit and signal system conduit having an inner electrically conductive beryllium alloy member 101, comprising, in the preferred embodiment, a beryllium copper alloy member, which is encapsulated in a dielectric material 102. A preferred dielectric material is amorphous polyimide. One non-limiting example of such an amorphous polyimide is commercially available from Richard Blaine International, Inc of Reading Pa.; although others should be suitable as well. In the embodiment of FIG. 1, encapsulating the dielectric material 102 is layer 103 which forms the final layer and thus the outermost surface of the system of the embodiment of FIG. 1. In preferred embodiments, outer material 103 is a conductive material which forms a mechanical shielding encapsulation around the dielectric material 102. One embodiment of fabrication of the device utilizes the placement of multiple layers of a polyimide dielectric material 102 to be cured onto a beryllium alloy member 101, which may be accomplished by passing the beryllium alloy member 101 through a series of curing stations after the dielectric encapsulation material 102 is applied to the surface of the beryllium alloy member 101. Preferably, encapsulation layer 103 serves as the outermost encapsulation of the submersible electrical transmission conduit 100, and in preferred embodiments uses a polymer doped with elements which enhance the electrical conductivity properties of encapsulation 103. The elements incorporated as dopant are well known to those engaged in the production and use of submersible and include zinc, tin, copper, iron, and other electrically conductive materials. Alternatively, encapsulation 103 may be a more conventional conductive material, such as a metal or metal alloy such as zinc or tin.

In another aspect of the present invention there are methods of sputtering electrical conductive elements onto the outer encapsulation surface of dielectric encapsulation 102 forming an outer encapsulation 103 with enhanced electrical conductivity and shielding properties. Use of polymeric solutions in both encapsulation layer 103 and encapsulation layer 102, that when cured are in an amorphous state, allows the submersible electrical system to be flexible for storage on reels, for well logging intervention methods, powering submersible devices like logging tools, submersible electrical motors attached to submersible well pumps, submersible electrical motors for drilling allowing for the encapsulation to be receptive to sputtering methods. However, it should be understood that other, preferably flexible, claddings, may be used. It can now be seen that this embodiment teaches the combination of novel new materials of construction, methods of construction thereof, and component arrangements to form an easily deployable, repairable, and extendable electrical power transmission, data signal transmission, and data collection lines which may be used for well logging, and powering permanently deployed measuring devices. Such devices include pressure, temperature, and acoustic devices, submersible umbilical cables for powering submarine devices, subterranean power transmission to power fluid lifting devices, and marine and aeronautical antennas for the collection of data using methods known to those in the field of aerospace as Synthetic Aperture RADAR Systems (SARS), and Synthetic Aperature Sonar Systems, (SAS) and other marine and aeronautical data gathering methods wherein a long hollow embodiment of my invention is used as an antenna and or receiver capable of transmitting electrical power whilst receiving echo captures at multiple antenna positions with receiving devices disposed on or in said antenna. For example, layer 103 can also be a zinc, tin, or other material wrapped, sputtered, or doped onto layer 103 to form the outer shield as opposed to polymeric coatings.

A further aspect of this invention is shown in FIG. 1, namely, that the outer encapsulation 103 need not comprise an electrically conductive member. This invention includes embodiments wherein electrical grounding of a submersible system is largely conducted through electrical submersible device connected to the submersible electrical transmission system of the invention. Non-limiting examples of such electrical devices are submersible electrical three phase motors, and three-phase electrical cables including those made commercially available by Baker Centrilift of Claremore Okla., Schlumberger Reda of Bartlesville Okla., and Electrical Submersible Pump Incorporated of Midwest City Okla. wherein the three electrical conductors of the submersible cable are connected at a "Y" in the electrical motor and the ground is then largely achieved through the motor and pump assembly to the well casing. The submersible structural electrical motor cables of the present invention incorporates three each of the cables of the invention shown as an apparatus 100 in FIG. 1, or 200 in FIG. 2 wherein the three said cables of the invention are packaged into a cable bundle for the supplying of three-phase electrical power to a submersible electrical motor. Currently, the electrical submersible cables for the electrical submersible motors used to power submersible pumps are made of copper and thus do not have sufficient yield strength to support their own weight and thusly must be attached or encapsulated in another strength member. The most common way that this problem is overcome in the current art is to attach electrical cable to the outer diameter of a production tubing string that is also deployed. Another means currently used by the oil and gas industry to support electrical power cables for electrical submersible motors involves disposing the electrical cables inside a continuous steel coiled tubing. In either case, the current industry electrical submersible pump systems are directed toward the use of non-electrically conductive member means to support the electrically conductive members of the submersible pump cables. The present invention encompasses a novel submersible electrical pump cable system that uses an electrically conductive beryllium alloy as a strength member and an electrically conductive member of a submersible electrical motor cable. The present invention also includes the use of the apparatus 200 of FIG. 2 wherein at least one portion of an electrical submersible cable comprises an electrically conductive beryllium tube 201. This tube is then used for the transmission of electrical power, and for the transmission of fluids to the submersible environment. The use of cavity 204 shown in FIG. 2 inside an electrically conductive beryllium alloy tube has advantages not realized by the electrical wire cables now used by the industry. These advantages of the electrically conductive strength member tube of the present invention include the injection and circulation from surface of dielectric fluids into submersible electrical motors, the injection of treatment chemicals for oil and gas wells (including, but not limited to, scale and corrosion inhibitors) through 204 of the apparatus 200 of FIG. 2, and the inflation of elastomeric sealing elements and devices in subterranean environments by pumping fluids from surface through the electrically conductive member 201 of apparatus 200 of FIG. 2, whilst simultaneously having the ability to transmit electrical power (and/or data) from surface to the down hole electrical pump through the electrical conductive beryllium alloy 201 in FIG. 2. The use of non-electrically conductive outer encapsulation of the beryllium alloy electrical conductive system of the present invention for electrical submersible motors is discussed herein by the way of an example and is not meant to be limiting. Clearly, the novel use of the methods of the present invention can be used to power many down hole electrical devices including pressure gauges, temperature gauges, solenoids, heaters, transmitters, receivers, and other well known electrical submersible devices.

Figure 2:
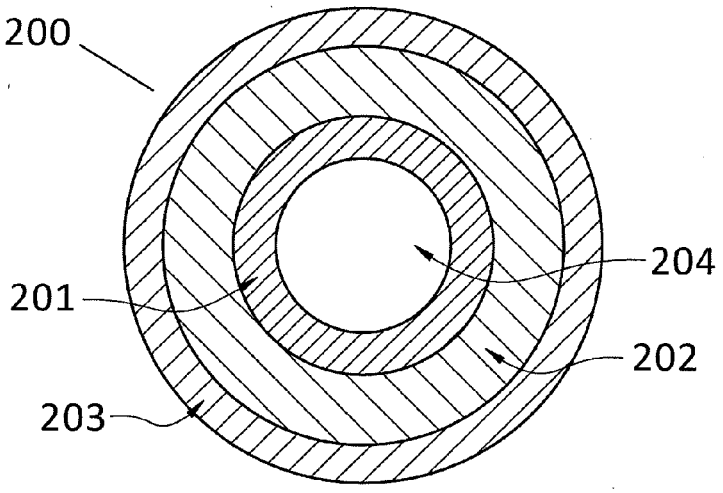
FIG. 2 illustrates a the preferred embodiment of this invention, constructing an electrically conductive insulated and shield copper beryllium alloy tube having a coaxial cavity along the length of a electrical transmission to form a submersible electrical transmission system.

Attention is now drawn to FIG. 2, which illustrates an alternative embodiment which comprises a submersible electrical power or data transmission conduit 200, wherein a beryllium alloy tube 201 is encapsulated in a amorphous dielectric material 202, which is itself encapsulated by an outer electrically conductive shielding encapsulation 203. FIG. 2 further illustrates an embodiment where a submersible electrical transmission system is arranged in a configuration that constitutes an electrically conductive hydraulic tube having a coaxial cavity 204. The coaxial cavity 204 maybe filled with inert gases, dielectric fluids, magnetic fluids, high magnetic permeability materials, wave guides, electrical conductors, magnets, electromagnetic transmitters or receivers, or a vacuum.

Figure 3:
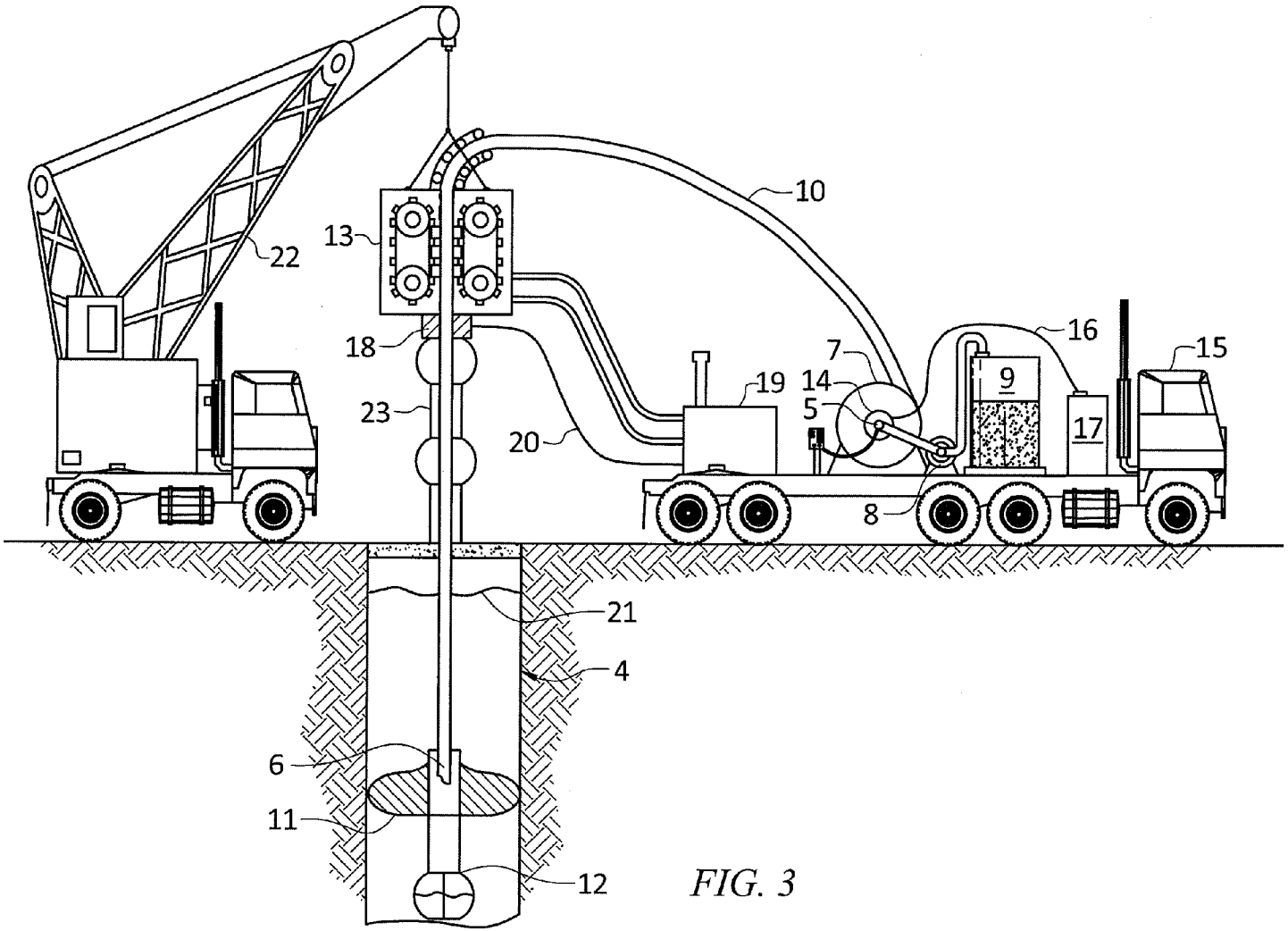
FIG. 3 illustrates the preferred embodiment of this invention methods of logging wells with a submersible electrical transmission system comprising a tube in a submersible environment of a well bore wherein an electrically conductive, insulated, and shielded beryllium copper alloy tube is used to transmit hydraulic fluid to an elastomeric subterranean device whilst transmitting electrical power down the same logging tube to electrical devices.

FIG. 3 illustrates an exemplary sketch of the preferred embodiment of the present invention in a land-based operation. In FIG. 3, a method of well logging with a submersible electrical beryllium copper alloy transmission logging tube system is depicted. A logging tube comprising a submersible electrical transmission conduit 10 is deployed into a subterranean well 4, the submersible electrical transmission conduit of this specific embodiment comprises a beryllium copper alloy tube having a coaxial cavity tube forming a portion of a submersible electrical transmission conduit 10 and the cross section if which is illustrated in FIG. 2. The submersible electrical power or data transmission conduit has a proximal end 5 at a surface location and a distal end 6 in a subterranean location wherein the submersible environment is separated from the surface environment around the submersible electrical transmission system 10 by an elastomeric seal 18 located on top of a wellhead 23 wherein the seal 18 is expanded around the submersible electrical transmission line 10 with hydraulic fluid from a hydraulic pump system through hydraulic line 20.

FIG. 3 further illustrates the beryllium copper alloy tube submersible electrical transmission system reeled onto a coil tubing reel 7 and attached at surface to a pump 8 pumping a fluid from a surface reservoir 9 into the submersible electrical transmission line 10 to inflate a subterranean elastomeric packer device 11 while transmitting electrical power or data signals (which can be analog or digital signals) to and from a suite of logging tools 12. FIG. 3 further illustrates a crane 22 suspending over well head 23, a coiled tubing injector head 13 engaging the electrical transmission line 10 to inject, hold, and retrieve the transmission line from the submersible environment of the well 4. FIG. 3 further illustrates the transmission of electrical power or data signals into and through the transmission line 10 at a slip ring 14 where electrical current is conducted from a logging truck 15 whist pumping fluid with pump 8 during both dynamic deployment of the logging tube or in static positions in the well. The slip ring enables the simultaneous transmission and collection of electrical power, data, optical power and signals, and transferring the same to surface data collection equipment, and computerization equipment attached to the data and power transmission system 10 of this invention. In the preferred embodiment, data is collected through a data line 16 disposed inside the logging tube, connected to computer 17 and/or other devices 17 known to those of skill in the art, and transmitted inside the logging truck 15 to computer and data storage devices. The data line 16 can be an electrical wire, and optical fiber as illuminated in FIG. 4.

Figure 4:
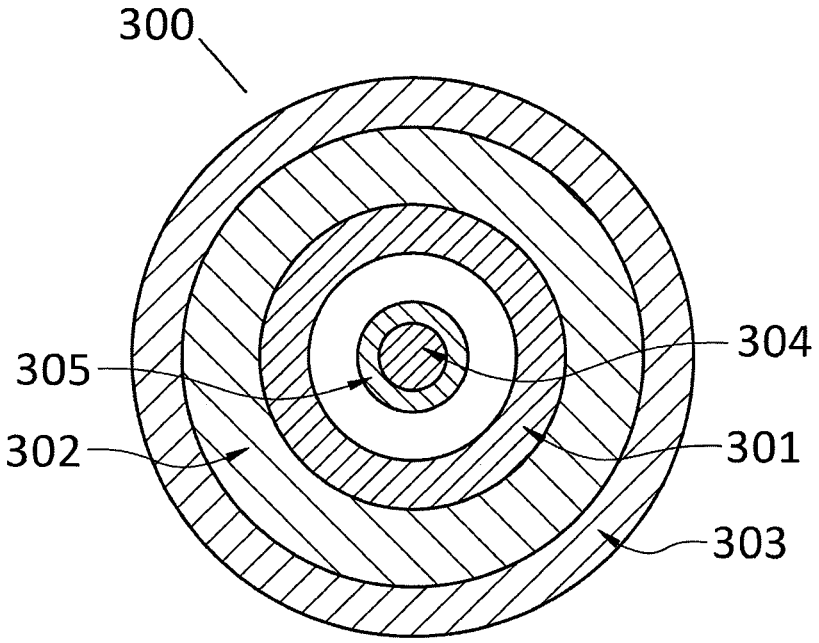
FIG. 4 illustrates the cross-sectional view of the preferred embodiment of a submersible electrical transmission system having an optical fiber loosely disposed in the coaxial cavity of an electrically conductive shielded beryllium copper alloy insulated tube.

FIG. 4 depicts another embodiment of a transmission conduit 300 comprising at least one additional member 304 disposed inside the beryllium alloy tube 301. The preferred embodiment comprises at least one optical fiber 304 encapsulated in a polymeric material 305 wherein the optical fiber cable is loosely disposed inside the beryllium alloy tube 301 which is encapsulated in an amorphous dielectric material 302 which is further encapsulated on the outer surface with an amorphous polymeric electrically conductive material 303. This additional member 304 in the preferred embodiment extends from surface at the proximal end (not visible in FIG. 4) of conduit 300. Member 304 is connected to a computer (not shown) and the distal end is in the well (not shown). As would be recognized by those of skill in the art of optical fiber data transmission, if the optical fiber 304 breaks, darkens or otherwise needs to be replaced by another optical fiber cable, the arrangement of a logging tube shown in FIG. 3 allows for the previously loosely-disposed optical fiber to be removed from the conduit space 204 of FIG. 2 and readily replaced with a different optical fiber cable. It is also understood by those familiar with the construction of continuous tube that the optical fiber 304 of FIG. 4 can be replaced or combined with electrical wires, or a combination of electrical wires, optical fibers, and electrical devices.

Again referring to FIG. 4, the beryllium copper electrically conductive logging tube 301 is depicted having an optical fiber 304 disposed therein. Optical fiber 304 could also comprise at least one electrical wire without departing from the scope of this invention. In either case of an optical fiber or an electrical wire, both can be depicted as encapsulated in a dielectric material 305 disposed inside the coaxial cavity of the beryllium copper alloy tube 301 where the beryllium copper alloy tube is encapsulated in at least one dielectric material 302 which is further encapsulated in a electrically conductive material 303. This outer electrical conductive material acts as a shield for both mechanical and electromagnetic effects on the system by the conductance of the submarine or subterranean environment. This outer material layer 303 aides to increase bandwidth on the submersible electrical system by increasing the inductance loads on the system like a Faraday cage.

In a preferred embodiment, a conduit comprising an optical fiber is used in conjunction with an Optical Time Domain Reflectometry (OTDR) device as a logging tool, either alone or as part of a suite of logging tools. However, it is important to note that any and all analytical logging methodologies, devices, and attachments suitable for or amenable to use in a well environment can be used as logging devices attached to the submersible electrical beryllium copper alloy tube transmission system described herein without departing the scope of this invention. This includes all spectroscopic and non-spectroscopic analytical methods, any and all temperature, pressure, acoustic, pulsed neutron, resistivity, and combination flow measurement and interpretation methods, of which are familiar to those of skill in the art of well logging. It should be understood that inserting a logging tool into a well bore comprises inserting some or all of the logging tools currently known in the art of oil and gas logging as well as well completion methods, wherein recording and injection devices are disposed permanently in submersible environments using beryllium copper alloy electrically conductive members. These and other variations should be considered within the scope of this invention as the use of any such permanent deployed systems and devices does not depart from the teachings of this invention.

In the case of the use of an OTDR device, the optical fiber is at least one of the component of the beryllium copper alloy tube system. The optical fiber is inserted into the well and extends to the surface, while preferably, the computer hardware, data recording, backscattered light monitoring, and LASER source that launch the light into the optical fiber preferably remain above the surface or other remote location. Gamma ray detection recording devices, electro-magnetic collar, density neutron, resistivity, electrical acoustical, pulsed neutron tools, detection recording devices, cameras, video recorders and perforating guns, explosive tool setting devices, are additional, non-limiting examples of logging and perforating tools that can be used in the present invention.

Those familiar with the art of metallurgy refer to peening or shot peeing as a means to impinge particles at a high velocity onto a surface. In the present invention, peening may be used in the construction process to modify the surface of a beryllium copper material.

Those of ordinary skill in the art of well logging refer to a plurality of tools and devices used to log wells as a suite of logging tools. A suite is formed by connecting one or more logging devices together into a train of tools lowered simultaneously into the well. A suite of tool can therefore comprise many combination of devices, instruments, and data transmission systems that a well engineer can select to gather the required well data. For example, a typical production logging suite of tools would include a flow meter device known as a spinner, a pressure measurement device often a strain gauge, a gamma ray device that monitors the radio-activity of the subterranean lithologies versus depth for depth correlation, a magnetic monitoring device often referred to as a casing collar locator that correlates the number of casing collars with the depth of the logging suite, an optical fiber inserted with the logging tube, that measures temperature and acoustics along its length to yield well profiles of temperature and sound, and many other combinations of logging tools that can be included in a logging tool suite. All such devices can be coupled to the transmission conduit of the present invention to realize performance advantages as well as increased durability.

As discussed above, the term "logging tool" includes both a single logging tool device or more than one logging tool device arranged in various combinations common to those familiar with the art of well logging, such that a suite or combination of logging tools are deployed simultaneously, and articulated in and out of the well with the submersible electrical transmission system and coiled tubing methods herein taught. While the preferred embodiments involve methods which use the conduit of the present invention as a beryllium alloy logging tube, it should be understood that the conduit may take the form of beryllium alloy rod, beryllium alloy wire, and combinations of the beryllium alloy wire, rod, and tube. For example, it will be understood by those familiar with the art of well completions that in certain wells, like horizontal wells, it becomes advantageous to push this inventions beryllium alloy rod as opposed to tube members, or wire members. The choice of form is dictated by the logistical and other considerations that are extant in the project at hand.

It will be clear to those familiar with the art of oil and gas production that certain wells and certain well conditions will require this inventions beryllium alloy rod, while others will require beryllium alloy wire, while still others will require beryllium alloy tubes. However, the preferred embodiment of the present invention is the use of the beryllium alloy tube member wherein the tube alloy has multiple synergistic attributes. These attributes comprise an electrical conductor member, a hydraulic transmission member, an electrical wire encapsulation member, an optical wave guide encapsulation member, and afford a novel an improved repairable submersible electrical logging system. Moreover, those familiar with the art of data collection will recognize that the beryllium tube can contain transmission devices and receiving devices allowing the beryllium tube to be disposed in environments as single or distributed arrays. These attributes have the useful industrial purpose of reducing the overall size, weight, and cost for many applications including, but not limited to, well logging while overcoming the shortcomings of prior art related to repairing the wire line logging cables, leaking grease injectors, and the lack of hydraulic power means. The improvements of this invention eliminate the well logging current industry problems of, leaking lubricators, grease injector, and crushing of electrical cable on logging drums. In the preferred embodiment, the beryllium alloy is a copper beryllium alloy tube which has a beryllium content of 0.2% to 2.5% by weight and can thusly support its own weight, be used with coiled tubing injector devices thereby reeling this inventions electrically conductive logging tube without wrapping loads as are common on current technology wire line logging methods. In the most preferred embodiment, the beryllium alloy has 0.2% to 0.6% beryllium, 1.4% to 2.2% nickel, with the remainder being copper.

FIG. 3 illustrates one exemplary use of the electrical power or data transmission conduit of the present invention, involving a well logging method with a beryllium alloy logging tube. It shows the step of well logging with the transmission conduit performed with a coiled tubing injector head 13, by inserting the submersible electrical transmission system into the submersible wellbore 4 below a fluid level 21. Nevertheless, other alternatives may be used. For example, the submersible electrical transmission system can be configured as a wire line cable and may be placed in a pressure lubricator on top of a wellhead, wherein weight bars and or a logging tool suite are connected and hung from the distal end of the submersible transmission system, the top of the system is sealed with a grease injector device familiar to those in the wire line logging industry, and the weighted logging tool suite is lowered into the well by a surface capstan device commonly known as a wire line drum, typically located on a well logging truck and well known to those familiar with the art of well logging. In an alternative embodiment, the submersible transmission system can be inserted into a well bore by pumping means (such means include, but are not limited to, triple pumps, centrifugal pumps, progressive cavity pumps, etc.) wherein the drag and fluid is used to transport the beryllium alloy electrical conductor member into a well. Further, the submersible transmission system can be retracted from the surface with capstan devices well known to those familiar with the art of well logging.

This invention includes the use a submersible electrical transmission system which comprises a submersible fluid sampling device on the distal end of the system. In this way, fluids from a submersible location of interest can be sampled.

In some instances the submersible electrical transmission is connected to a submersible logging tool suite which may also comprise at least a fluid pressure monitoring device, a fluid sampling chamber, a gamma ray logging tool, and density logging tool, a electromagnetic logging tool, and other subterranean devices known to those familiar with the art of well logging.

Figure 5:
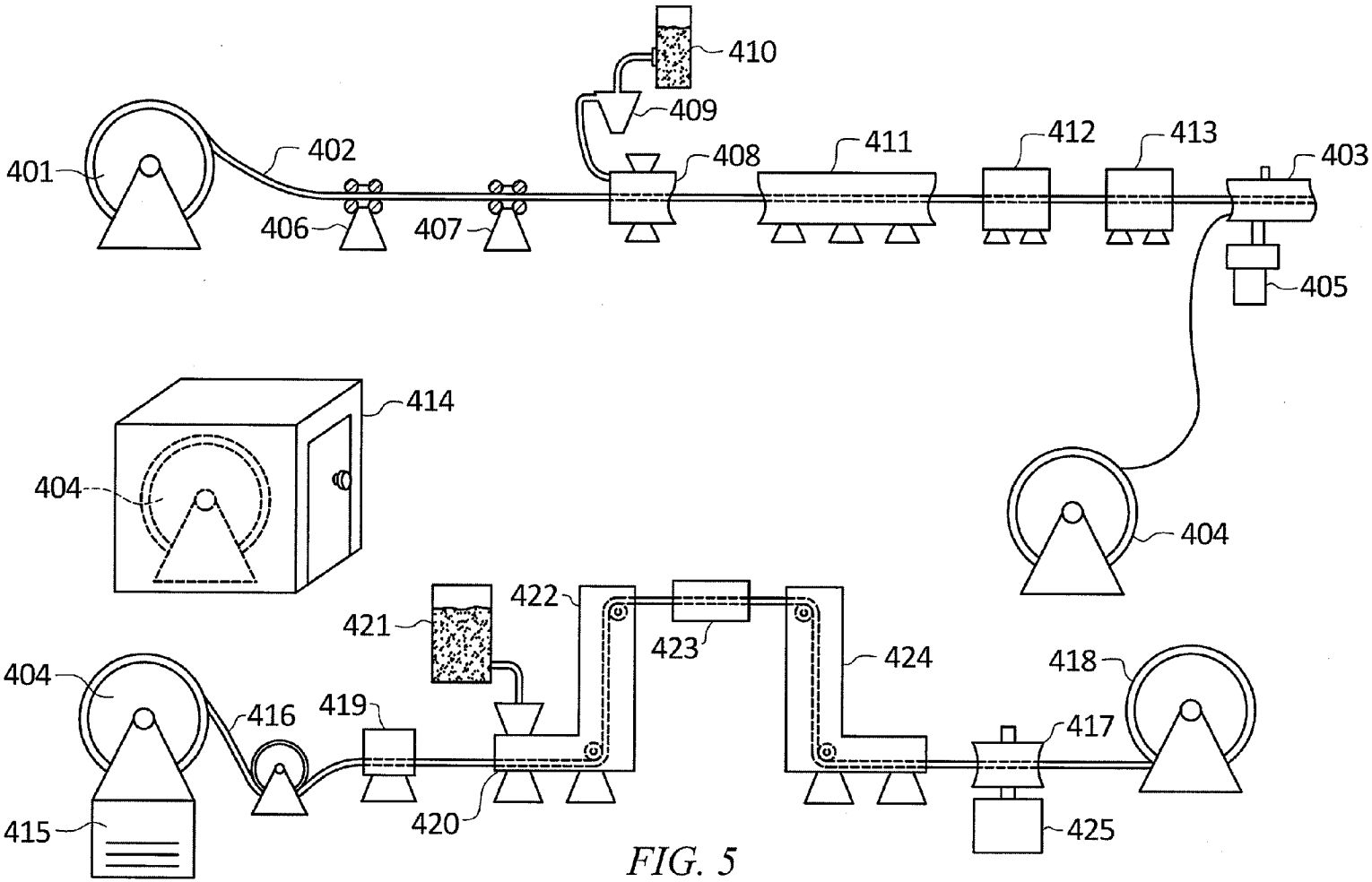
FIG. 5 illustrates the preferred embodiment of a process for constructing and combining materials to form a submersible electrical transmission system having an electrically conductive shielded beryllium copper alloy insulated tube.

Attention is now drawn to FIG. 5 demonstrating a preferred method of constructing a beryllium copper alloy tube apparatus by converting a soft heat-treatable beryllium copper alloy strip into a long tube of shielded, insulated, and enhanced beryllium copper alloy for optimal mechanical and electrical properties. Although this example focuses on beryllium copper, it should be understood that other beryllium alloys are also applicable. FIG. 5 depicts a reel, item 401, of soft heat treatable copper beryllium strip 402 presented at the beginning of the process. The construction process is started by attaching one end of a length of a "pulling dummy tube" to the strip 402 by an attachment means (such attachment means include, but are not limited to, weldments, ferrule fitting connectors, etc.) and running the "pulling dummy tube" through the mill and around the capstan 403 and terminating on collection reel 404 for tube at the distal end of the mill. The process is further depicted in FIG. 5 by showing the pulling of beryllium copper strip 402 from the reel 401 with the capstan 403 powered by an electrical motor 405. The strip is formed into a tube shape over a series of roller stations depicted as 406 and 407 in FIG. 5 as strip is pulled and formed into a tube shape through the mill with the capstan 403 and collected on the reel 404 at the end of the tube mill process. It is clear to those familiar with the art of tubing mills that the quantity of roller stations can be changed as required by the material and the diameters of tube outer diameter one wishes to form without avoiding the spirit of this invention. Once the strip 402 is converted and transformed into a tube geometrical shape the tube is welded at station 408 with a TIG welding system as the strip is continually pulled through the process by the capstan. It is important to note that at station 408 that the welding gases and dust are captured and circulated to a dust collector and water bath separator 410 to where they are collected. It is clear to those familiar to the art of continuous tubing manufacturing that the welding device 408 can be comprise other welding means including LASER welding means using for example LASER devices and/or any other devices known to those of skill in the art. After welding, the tube is pulled through a high temperature annealing station 411 to relieve stresses in the tube from welding and homogenizing the matrix grain structure of the beryllium copper alloy. It is clear to those familiar with the art of tubing mills and alloy metallurgy that the residence time in the annealing station 411 can be controlled by increasing the length of the annealing station 411 or slowing the speed of the mill process by means of slowing the capstan pulling speed. Likewise, it is clear to those familiar with the art of metallurgy that different alloys require different annealing temperatures and residence times which can be adjusted by controlling the annealing stations temperature and mill speed. Very long annealing stations can be formed using stationary furnace designs and the designs can anneal the tube in inert and noble gas environments all of which do not depart from the scope of this invention. The tube is pulled forward by the capstan 403 and passes next through a quenching station 412 where it is cooled then onto a mechanical drawing station 413 where the diameter is reduced mechanically thereby changing the mechanical and electrical properties of the tube. The tube is then collected on the collection reel 404. The tube now collected on reel 404 is then moved to a batch furnace 414 where the tube is optimally heated and aged at controlled heat up rates, held at temperature, and then cooled down as required to reach the optimal electrical and mechanical properties of the alloy. It is clear to those familiar with beryllium alloy metallurgy that many schedules of heating, time aging, and cooling can be performed to optimize the properties required of the tube and such schedules depend on the exact constituents of the beryllium copper alloys. Once the tube on reel 404 has obtained the require mechanical and electrical properties in the furnace 414 it is removed from the batch furnace 414 and presented to the beginning position 415 of an encapsulation mill. The mechanically and thermally enhanced tube 416 is connected to a dummy pull tube with an attachment means such as a weld or ferruled connector device (although other equivalent means may be used) and run through a encapsulation mill depicted in FIG. 5 by pulling the tube through the encapsulation mill stations with the capstan 417 and collecting the encapsulated tube on the collection reel 418. The first station that tube 416 passes through in the encapsulation mill is a cleaning bath 419 progressing thereafter to the encapsulation bath 420 where a polyimide fluid 421 (other dielectric materials may be used) is applied to the tube outer diameter and heated and cured in a vertical furnace 422 and then the tube is pulled continuously through to a sputtering station 423 where materials are added to coat the encapsulating and subsequently the tube is further pulled and progressed to a cooling station 424 and on through to the capstan 417 which is driven by the electrical motor 425 and then collected on reel 418. This encapsulation process can be repeated multiple times, thereby placing multiple coatings and sputtering materials on the continuous tube assembly. Also a given continuous tube can pass through several encapsulation mills which may be used each to coat and encapsulate using different materials, different curing temperatures, and transient times.

In almost all applications in the oil and gas industry, the structural member/conduit will have a length of greater than 1000 feet (304.8 meters). In typical applications, it will have a length of greater than 3000 feet (914.4 meters). In other applications, it will have a length of greater than 5000 feet (1524 meters). In some applications, such as deep-sea oil and gas operations, it will have a length of greater than 7000 feet (2133.6 meters), and in some cases, greater than 10,000 feet (3048 meters).

The beryllium alloy conductive conduit preferably has an electrical conductivity value greater than 25% of the International Annealed Copper Standard (IACS). However, in some applications, it may have an electrical conductivity value greater than 1% of IACS. In other applications, it may have an electrical conductivity value greater than 10% of IACS. In other applications, it may have an electrical conductivity value greater than 30% of IACS. In other in some applications, it may have an electrical conductivity value greater than 40% of IACS. In other applications, it may have an electrical conductivity value greater than 50% of IACS. In yet other applications, it may have an electrical conductivity value greater than 60% of IACS. In other applications, it may have an electrical conductivity value greater than 70% of IACS. In other applications, it may have an electrical conductivity value greater than 80% of IACS. The choice is variable depending upon the particular application and the combination of conductivity and strength needed.

In the preferred embodiment, the structural member comprises the electrical conduit. In all cases, a significant portion of the overall mechanical strength (and in most cases, substantially all of the overall mechanical strength of the structural member) is provided by the electrical conduit. Because a primary advantage of the present invention is an electrical conduit also acting as a strength member, in some cases, the structural member and the electrical conduit are one and the same and no other components are present. In other words, in such cases the structural member consists of the electrical conduit. However, in some cases, the structural member may consist of some additional components that do not significantly affect overall strength of the member; in such cases the structural member consists essentially of the electrical conduit.

It should be understood that variations, changes, and substitutions recognized by those of ordinary skill in the art upon a reading of this disclosure are within the scope of the invention. For example, the continuous beryllium copper alloy tube collected at the end of the mill on reel 404 maybe connected to another reel of tubing with a butt weld, and the two adjoined continuous tubing lengths now form a substantially longer continuous tubing length and thereafter can be run through a similar milling process further drawing down the size of outer diameter of the substantially longer continuous connected tube lengths. These butt welded tube lengths can also be drawn over a mandrel in a mill process. It is further understood that this weld connection of two or more continuous lengths can be made with welding TIG means or electromagnetic pulse welding means to avoid a heat affected zone at the butt welds.

Although the present invention and its advantages have been described in detail, it should be understood that various changes, substitutions, and alterations can be made to the process discussed herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A structural member comprising:

a conductive electrical conduit for transmission of electrical power or data, said conduit comprising:

a core conductive member comprising a first conductive material, the first conductive material comprising beryllium alloy, the beryllium alloy having an electrical conductivity value greater than 25% International Annealed Copper Standard (IACS) and having a 0.2% offset yield strength greater than 30,000 psi;

a first layer encapsulating the core conductive member, the first layer comprising a dielectric material; and, a second layer encapsulating the first layer;

said structural member having a length of greater than or equal to 1000 feet and having a tensile strength greater than or equal to a tensile strength sufficient to resist yield under a load of its own weight.

2. The structural member of claim 1, wherein the second layer comprises a second electrically conductive material.

3. The structural member of claim 2, wherein the second conductive material comprises beryllium alloy.

4. The structural member of claim 1, wherein the second layer comprises a doped polymer.

5. The structural member of claim 1, wherein the first layer comprises amorphous polyimide.

6. The structural member of claim 1, wherein the core conductive member comprises a beryllium alloy tube, wherein the beryllium alloy comprises a tubular shape with a central cavity.

7. The structural member of claim 1, wherein the beryllium alloy is copper beryllium alloy.

8. The structural member of claim 1, wherein the core conductive member comprises a beryllium alloy tube, wherein the beryllium alloy further comprises a tubular shape encapsulating a third electrically conductive material.

9. The structural member of claim 8, wherein the third electrically conductive material is copper wire.

10. The structural member of claim 1, wherein the core conductive member comprising beryllium alloy comprises a tubular shape, the tubular-shaped beryllium alloy encapsulating a fourth material.

11. The structural member of claim 10, wherein the fourth material comprises optical fiber.

12. The structural member of claim 1, wherein the structural member is substantially free of an additional component providing mechanical strength to the conduit greater than or equal to the combined mechanical strength provided by the core conductive member, the first layer and the second layer.

13. The structural member of claim 1, wherein the structural member consists essentially of said conductive electrical conduit.

14. The structural member of claim 1, wherein the structural member consists of said conductive electrical conduit.

15. A method of transmitting electrical power or data to or from a subterranean or submarine environment to or from a second location, the method comprising:

coupling, through a structural member, one or more components in the subterranean or submarine environment to one or more components at the second location, the structural member comprising:

a conductive electrical conduit for transmission of electrical power or data, said conduit comprising:

a core conductive member comprising a first conductive material, the first conductive material comprising beryllium alloy having an electrical conductivity value greater than 25% International Annealed Copper Standard (IACS) and having a 0.2% offset yield strength greater than 30,000 psi;

a first layer encapsulating the core conductive member, the first layer comprising a dielectric material;

a second layer encapsulating the first layer;

said structural member having a length of greater than or equal to 1000 feet and having a tensile strength greater than or equal to a tensile strength sufficient to resist yield under a load of its own weight; and, transmitting the electrical power or data through the conductive electrical conduit between the one or more components at the second location and the one or more components in the subterranean or submarine environment.

16. The method of claim 15, wherein the second layer comprises a second electrically conductive material.

17. The method of claim 15, wherein the electrical power is provided to a submarine environment in the exploration or production of hydrocarbon resources, and the second location is at or above the marine surface.

18. The method of claim 15, wherein the electrical power is provided to a subterranean environment in the exploration or production of hydrocarbon resources, and the second location is at or above the surface of the earth.

19. The method of claim 15, wherein the second conductive material comprises beryllium alloy.

20. The method of claim 15, wherein the second layer encapsulation comprises a doped polymer.

21. The method of claim 15, wherein the first layer comprises amorphous polyimide.

22. The method of claim 15, wherein the core conductive member comprises a beryllium alloy tube, wherein the beryllium alloy comprises a tubular shape with a central cavity.

23. The method of claim 15, wherein the beryllium alloy is copper beryllium alloy.

24. The method of claim 15, wherein the core conductive member comprises a beryllium alloy tube, wherein the beryllium alloy further comprises a tubular shape encapsulating a third electrically conductive material.

25. The method of claim 24, wherein the third electrically conductive material is copper.

26. The method of claim 15, wherein the core conductive member comprising beryllium alloy comprises a tubular shape, the tubular-shaped beryllium alloy encapsulating a fourth material.

27. The method of claim 26, wherein the fourth material comprises an optical fiber encapsulated in a polymeric material.

28. The method of claim 15, wherein the conduit is substantially free of an additional component providing mechanical strength to the conduit greater than or equal to the combined mechanical strength provided by the core conductive member, the first layer and the second layer.

29. The method of claim 15, wherein the structural member consists essentially of said conductive electrical conduit.

30. The method of claim 15, wherein the structural member consists of said conductive electrical conduit.

31. The method of claim 15, further comprising the step of powering submersible electrical devices.

* * * * *